United States Patent [19]

Kerner et al.

[11] Patent Number: 4,792,059

[45] Date of Patent: Dec. 20, 1988

[54] SEALED HOT, COLD AND ROOM TEMPERATURE PURE WATER DISPENSER

[75] Inventors: James M. Kerner, Chico; Carl Palmer, La Habra; Kenneth A. Betts, Chico, all of Calif.

[73] Assignee: United States Thermoelectric Corporation, Chico, Calif.

[21] Appl. No.: 10,772

[22] Filed: Feb. 4, 1987

[51] Int. Cl.[4] ..... B67D 3/00; B67D 5/58; B67D 5/62

[52] U.S. Cl. ..... 222/67; 222/129.1; 222/144.5; 222/145; 222/146.1; 222/189

[58] Field of Search ..... 222/67, 129.1, 129.2, 222/129.3, 129.4, 144.5, 145, 146.1, 146.2, 146.5, 146.6, 189, 130; 221/310; 137/571, 575, 263, 255, 261; 4/192

[56] References Cited

U.S. PATENT DOCUMENTS

| | | | |
|---|---|---|---|
| 48,421 | 6/1865 | Matthews | 251/7 |
| 1,336,469 | 4/1920 | Luellen | 221/310 |
| 2,767,960 | 10/1956 | Fast | 222/146.1 X |
| 2,963,202 | 12/1960 | Dickinson et al. | 222/144.5 |
| 3,572,553 | 3/1971 | Ogden | 222/67 |

FOREIGN PATENT DOCUMENTS

| | | | |
|---|---|---|---|
| 483372 | 6/1917 | France | 137/571 |
| 732452 | 6/1955 | United Kingdom | 222/129 |

*Primary Examiner*—Joseph J. Rolla
*Assistant Examiner*—Stephen Parker
*Attorney, Agent, or Firm*—Cahill, Sutton & Thomas

[57] ABSTRACT

Purified water is fed into an elevated sealed first tank by means of a float valve assembly. The first tank is vented by a bacteria microscreen which is located above the level of a three-way spigot manifold. A second insulated, sealed hot water tank and a third insulated, sealed cold water tank, both positioned below and fed by the first tank, are vented into the first tank. The second tank is heated by a controlled heat strip or thermoelectric module. The second tank is positioned above and feeds into the third tank, which is cooled by a thermoelectric module. Each of the three tanks is connected by a respective tube into a three-way spigot manifold. An ergonomically designed cabinet in which the three tanks are housed includes a three button spigot control assembly located in a recess approximately 36 inches above the floor. The spigot manifold is positioned in a front panel recess beneath the button recess adjacent to a paper cup dispenser. Airborne and human-carried bacteria and contaminants are prevented from entry into the sealed system.

12 Claims, 4 Drawing Sheets

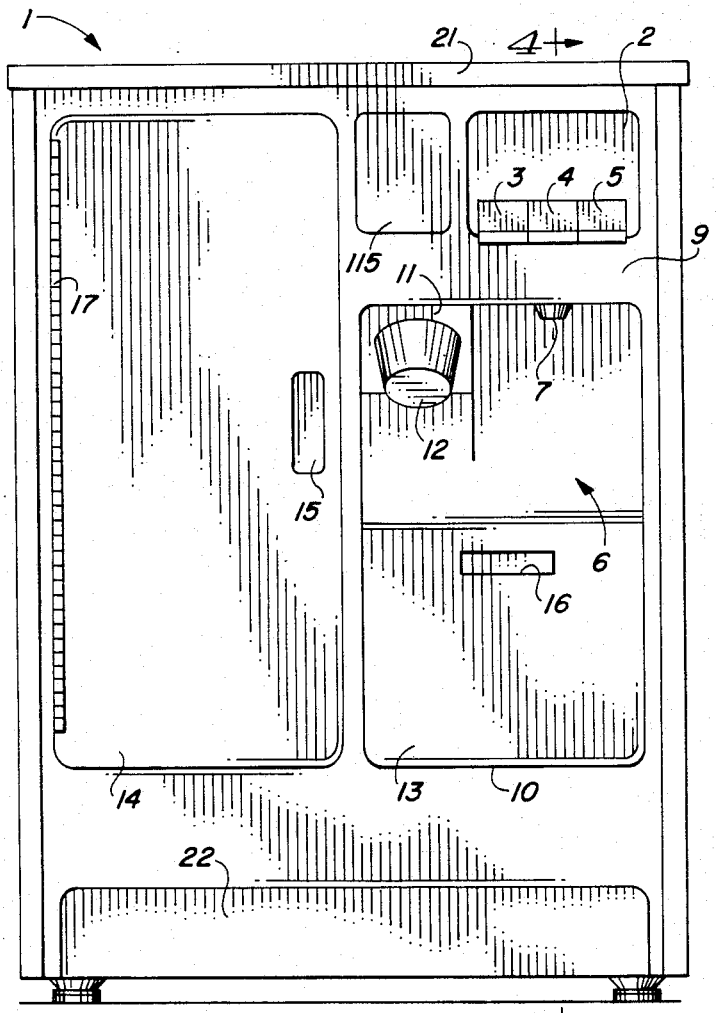
FIG. 1
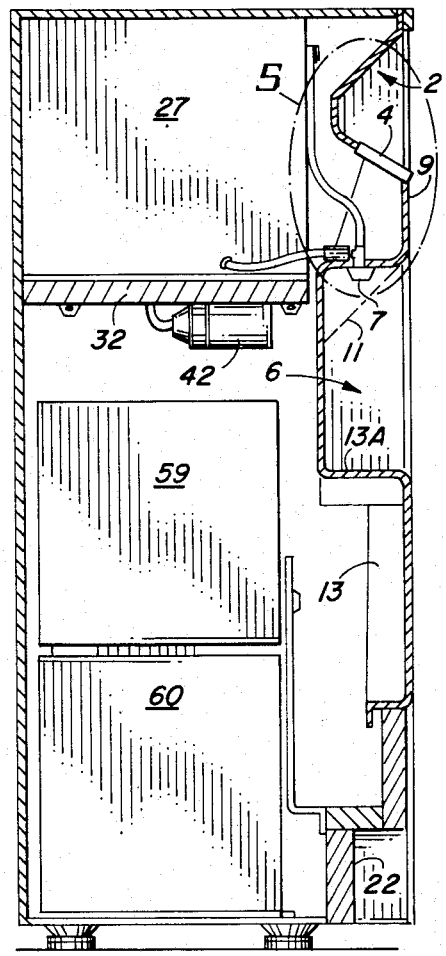
FIG. 4
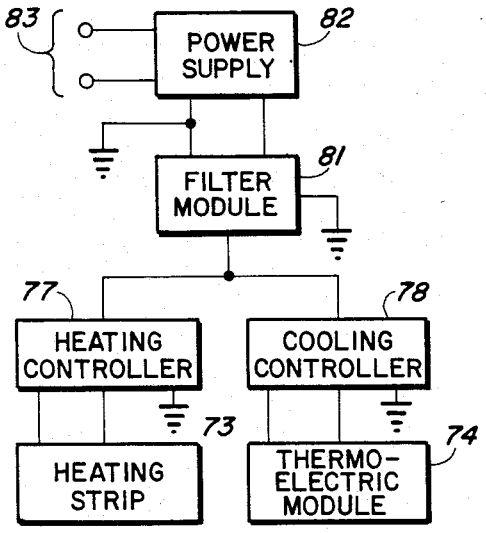
FIG. 3
FIG. 8A
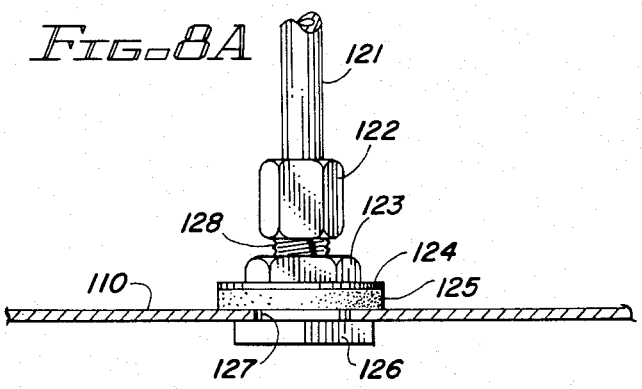
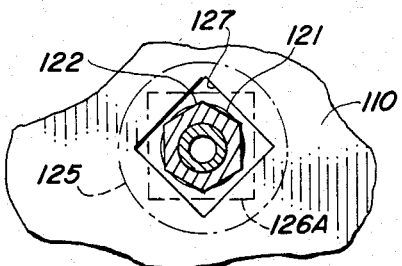
FIG. 8B FIG. 2
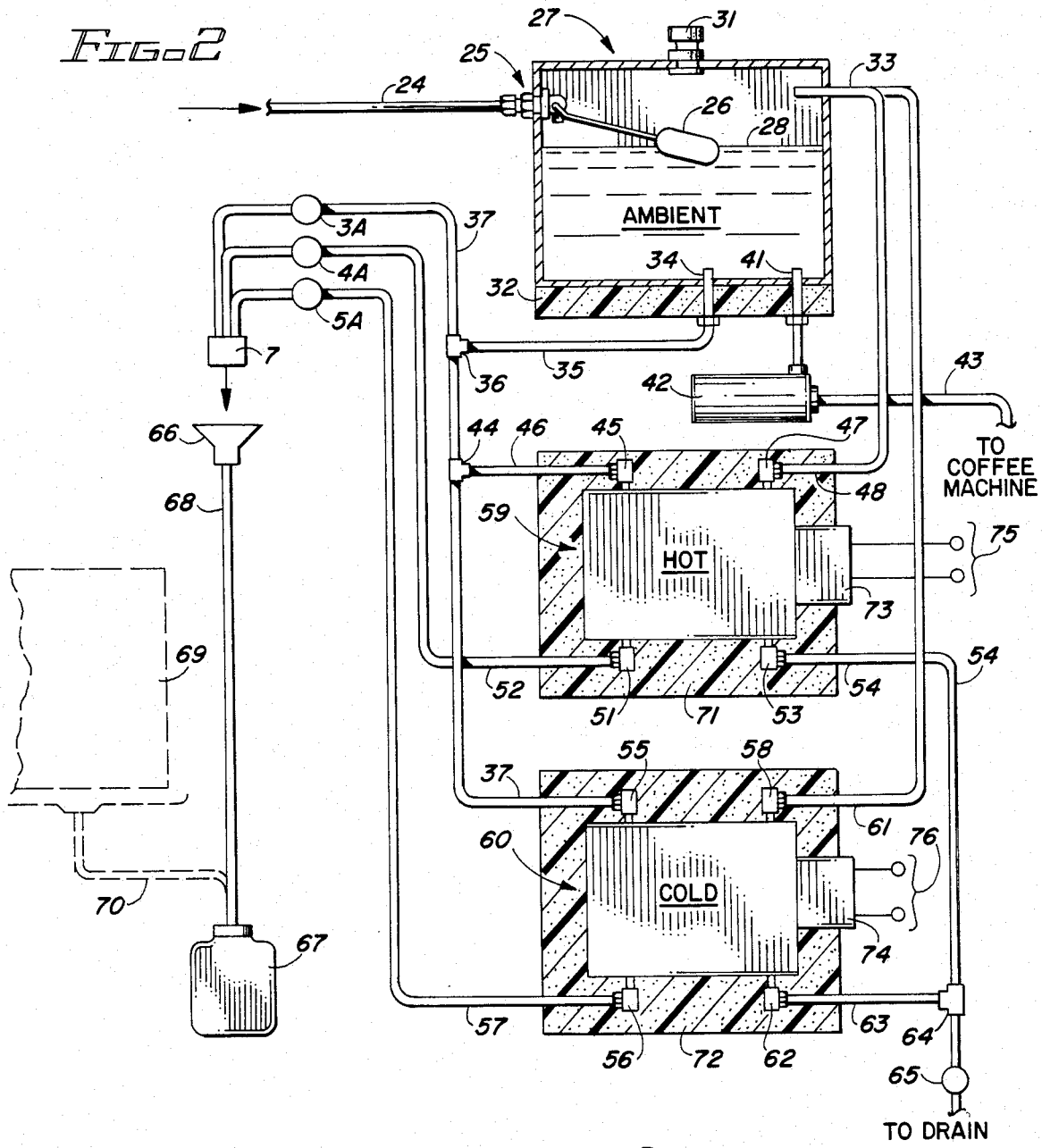
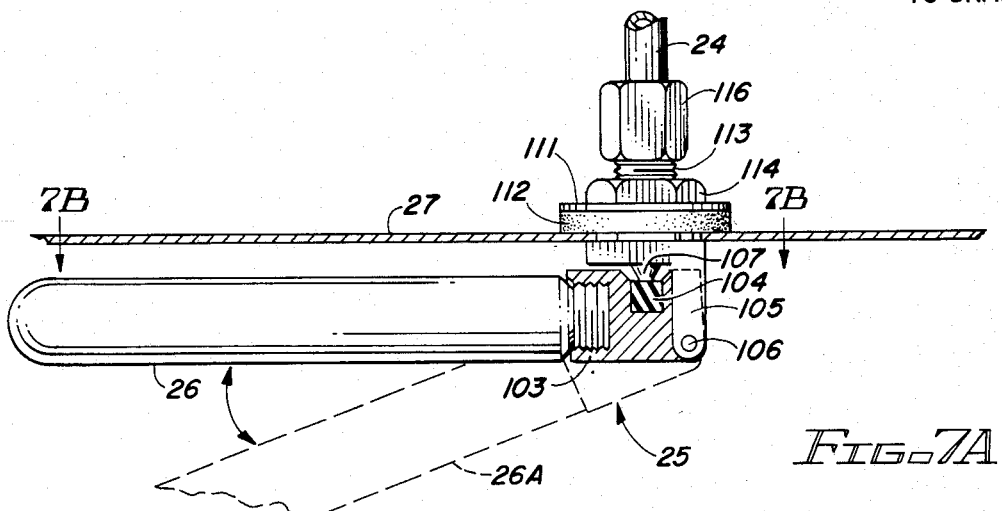
FIG. 7A

SEALED HOT, COLD AND ROOM TEMPERATURE PURE WATER DISPENSER

BACKGROUND OF THE INVENTION

The invention relates to devices for delivering heated and chilled purified water, and more particularly to such systems which avoid common contamination by airborne bacteria, contaminants, etc., and by germs, contaminants, etc., carried by the hands of the users, and more particularly to an ergonomic design of such a purified water delivery system.

Manufacture and sale of hot/cold drinking water delivery systems for residential and commercial use is a large worldwide industry. Various sources of purified water, such as reverse osmosis filters, activated charcoal filters, and the like frequently are utilized in such systems to remove viruses, bacteria, pyrogens, carcinogens, pesticides, detergents, radioactive contaminants, and other contaminants from drinking water. Most prior delivery systems are "open" systems in which bottled water, usually supplied in five gallon containers, is poured into an open reservoir from the inverted delivery bottle. An electrical heating unit typically is utilized to heat water delivered to a hot water spigot with a depressible control valve located an inch or so above the delivery tube. Cold water is provided by a heavy, electrical compressor unit that chills the water in the open reservoir. Other prior systems receive pressurized water. Paper cup dispensers frequently are attached to such machines, but paper cups other than the one which the present user intends to drink from often are touched by the hand of the user because several cups are often dispensed when only one is desired. The user frequently attempts to push the undesired cups back into the dispenser, possibly transmitting bacteria, germs, or contaminants to them. Frequently, when the prior paper cup dispensers are initially loaded, quite a number of the paper cups being loaded will be touched by the hands of the person loading them. Contaminants from the hands of persons actuating the dispensing valves also may find their way to the mouths of the delivery nozzles and into a drinking cup due to the close spacing of the valves to the nozzle.

Thus, the state-of-the-art for pure water delivery systems is that they are much more subject to contamination from airborne substances and human-carried substances than is generally realized. Furthermore, the presently available systems are rarely if ever thoroughly cleaned and disinfected by maintenance personnel.

Most existing bottled water dispensing units require the user to pick up a full five gallon bottle, which weighs over 40 pounds, invert it, and position it into the mouth of the open holding tank. This frequently causes spills, operator injury, and transfer of contaminants from the mouth and neck of the water bottled to water in the holding tank.

In the past, when sealed "food grade" containers have been manufactured for various purposes, tubes connected to such tanks have been silver soldered thereto. The resins used in the soldering operations are toxic, so it is necessary to clean the interiors of the tanks after the silver soldering operation. Unfortunately, the cleaning materials frequently also are toxic.

There is a need for an economical purified water delivery system for dispensing room temperature water, hot water, and cold water which avoids contamination from airborne bacteria and other contaminants, and also avoids contamination from the hands of users, and which does not require frequent cleaning and disinfecting to maintain a high level of purity of dispensed water.

SUMMARY OF THE INVENTION

Accordingly, it is an object of the invention to provide a completely sealed purified water delivery system for residential and commercial use, which avoids contamination from airborne and human-carried contaminants.

It is another object of the invention to provide an efficient, inexpensive, ergonomic dispenser for purified water at room temperature, high temperature, and cold temperature water.

It is another object of the invention to provide a reliable, low pressure pure water delivery system in accordance with the foregoing objectives.

Briefly described, and in accordance with one embodiment thereof, the invention provides an apparatus for dispensing purified water, including a sealed holding tank, a sealed hot water tank, and a sealed cold water tank, the hot and cold water tanks being positioned in a cabinet beneath the holding tank and being gravity fed thereby through sealed tube connections, the hot and cold water tanks being vented into an upper portion of the holding tank, the holding tank being vented to the atmosphere by the microscreen filter, each of the three tanks being connected by a separate dispensing tube and a separate pinch valve to first, second, and third dispensing ports. Each of the pinch valves is connected by an elongated linkage element to a separate spring biased depressible control button which, unless depressed maintains the pinch valve closed. In the described embodiment of the invention, the dispensing tubes are composed of flexible surgical tubing which is easily pinched off by a loop at the bottom of the respective linkage member. The hot, cold, and room temperature dispensing buttons are disposed in a recess disposed approximately 8 inches above a dispensing recess, and the top portion of which the three dispensing ports are located. A novel paper cup holder including an inclined paper cup storage tube with an inclined dispensing flange at its lower end is positioned in a recess adjacent to and at the same level as the dispensing recess. The dispensing flange is composed of a thin layer of flexible plastic having a circular opening therein which clears the perimeter of the paper cups, and a plurality of spaced tabs along the edge of the circular opening which retain a stack of paper cups in the dispensing tube, and which yield to the lip of a paper cup being removed, and recover rapidly to engage the lip of the next paper cup in the stack. The hot water tank is heavily insulated, and makes intimate thermal contact with an electric heating element, which may be resistive or thermoelectric. The cold water tank also is heavily insulated, and is maintained in low thermal resistance contact with a thermoelectric module. In the described embodiment of the invention, the capacity of the holding tank is at least equal to the combined capacity of the hot water tank and the cold water tank, both of which are composed of stainless steel. A float valve which limits the flow of pressurized purified water into the holding tank when the water level inside the holding tank reaches a certain level includes a threaded cylindrical section extending upward from a valve body having a square perimeter that is slightly smaller than a corresponding square cutout hole in the holding tank means and a passage through the threaded cylindrical section and through the valve body to a nozzle. The valve body is positioned inside the holding tank means and oriented so that its square perimeter section is rotated 45 degrees relative to the square cutout hole. The threaded cylindrical section extends upward through the square cutout hole. The float valve means includes a resilient plastic seal washer disposed on the outside surface of the holding tank around the threaded cylindrical section, covering the edge of the square hole cutout and sealing the outer surface of the holding tank means to the threaded cylindrical section. A rigid flat washer is disposed about the threaded cylindrical section on the surface of the plastic seal washer and tightened thereto by means of a threaded nut. A float mechanism inside the holding tank is pivotally connected to the valve body, and has a resilient seal that engages and seals the nozzle, which is located inside the holding tank, when the float mechanism is pushed upward by water in the holding tank. The float mechanism is elongated in a sufficiently small cross section that it can be inserted into the holding tank means, with the valve body, to allow installation thereof.

BRIEF DESCRIPTION OF THE DRAWINGS

FIG. 1 is a front elevation view of the water dispensing system of the present invention.

FIG. 2 is a diagram illustrating the plumbing in the delivery system of FIG. 1.

FIG. 3 is a block diagram of the electrical system utilized in the water delivery system of FIG. 1.

FIG. 4 is a section view taken along section line 4—4 of FIG. 1.

FIG. 7A is a side elevation view of the float valve utilized in the room temperature supply tank of FIG. 2.

FIG. 8A is an elevation view of the tank insert fittings utilized in FIG. 2.

FIG. 8B is a top plan view of the tank insert fitting of FIG. 8A.

DESCRIPTION OF THE INVENTION

Figure 5:
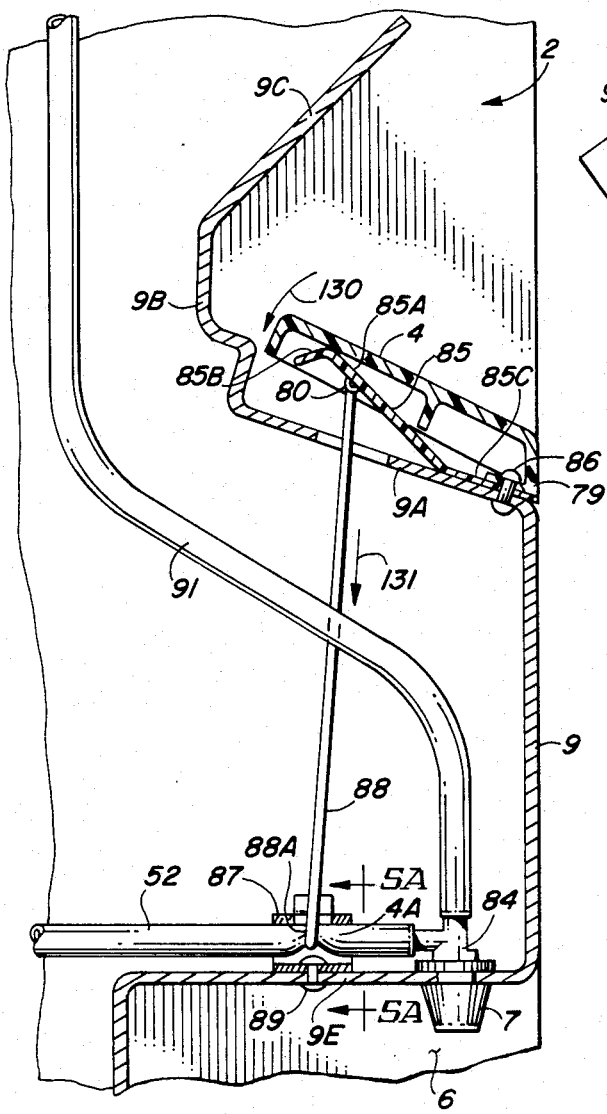
FIG. 5 is an enlarged section view useful in describing the three dispensing valves of the delivery system of FIG. 1.

Referring now to the drawings, FIG. 1 shows the front elevation view of the dispensing system of the present invention. Dispensing unit 1 includes a front panel 9. A dispensing button recess 2 is provided in a front panel 9. Three control buttons 3, 4, and 5 are disposed in the lower portion of recess 2, to allow the user to select room temperature, hot, or cold water to be delivered through a manifold 7 into a paper cup or coffee pot held below manifold 7 in an 8 inch high dispensing recess 6. The paper cup 12 is pulled out of a paper cup storage tube through a unique dispensing flange 11.

The three selection buttons 3, 4, and 5 are inclined at an angle of approximately 16 degrees in recess 2, as best indicated by reference numeral 4 in FIG. 4. The paper cup dispensing flange 11 is disposed at an angle of approximately 45 degrees, as best indicated by numeral 11 in FIG. 4.

An overflow container (not shown) is included in a region behind a door 13, which is connected by a bottom hinge 10 to front panel 9. A handle recess 16 allows door 13 to be swung down to remove an overflow container from the region behind door 13. A suitable grate and funnel assembly allows water that may be spilled from the cup 12 or manifold 7 to be collected in the overflow container.

A door 14 connected by a vertical hinge 17 can be opened by a handle recess 15 to allow access to a thermoelectric refrigerator, which may be provided in the recess behind door 14.

In the described embodiment of the invention, a counter top 21 having an elevation of approximately 40 inches is provided. A coffee machine or other accessory can be placed on this surface. The dispensing control buttons 3, 4, and 5 are located 36 inches above the floor. The manifold 7 is located 29 inches above the floor level. A recessed toe region 22 is provided to prevent users standing in front of the dispenser 1 from kicking the bottom edge with the toes of their shoes.

As subsequently described, three separate tubes for delivering ambient, hot, and cold temperature water as selected by the buttons 3, 4, 5 feed into the single manifold 7 so that the selected stream of water never touches the mouth of manifold 7. This avoids contamination of the selected stream of water by germs or other contaminants that may somehow become deposited on the mouth of manifold 7. The mouth of manifold 7 is located sufficiently far below buttons 3, 4, and 5 that germs from the hands of the users cannot be deposited on the mouth of manifold 7. The upward orientation of the buttons 3, 4, and 5 prevents the user's button depressing hand from ever coming close to either the cup or manifold 7. As subsequently described, the reliable paper cup dispensing device avoids the likelihood that more than one cup at a time will be removed from the dispenser flange 11, avoiding the need for a user who inadvertently removes more than one cup to be tempted to push it back into the dispenser.

Referring now to FIG. 2, the manifold 7 of FIG. 1 receives the above-mentioned three separate tubes, designated by reference numerals 37, 52, and 57, which are respectively connected to a sealed stainless steel 4.25 gallon holding tank 27, a heavily insulated sealed stainless steel hot water tank 59, and a heavily insulated sealed stainless steel cold water tank 60, respectively. Non-locking valves 3A, 4A, and 5A are actuated by buttons 3, 4, and 5, respectively, to allow room temperature, hot, or cold water, respectively, to be dispensed from the corresponding tank to manifold 7. Hot water tank 59 and cold water tank 60 each are 1.25 gallon tanks. A layer of thermal insulation 32 is provided beneath holding tank 27 for the purpose of preventing any heat from hot water tank 59 from heating the water in holding tank 27, because cooling water is less efficient than heating it.

Pressurized water from a filter, such as a reverse osmosis filter, is fed through a tube 24 into a float valve 25, described in detail subsequently with reference to FIGS. 7A and 7B. A float 26 connected to float valve assembly 25 establishes the level 28 of purified room temperature water in tank 27. Air in the region above water surface 28 is filtered by a biological bacteria microscreen 31 in a vent opening in the top of stainless steel tank 27. A variety of suitable microscreen filters are commercially available, such as a 0.2 micron Zeta-Pore filter available from Cuno, Inc. of Meridan, Conn. In accordance with the present invention, no unfiltered air ever gets into the sealed system shown in FIG. 2. A vent inlet 33 into the space above water level 28 is connected to allow the hot water tank 59 and the cold water tank 60 to be vented into holding tank 27, in case the system is flushed.

A fitting 34 through the bottom of holding tank 27 is connected by tube 35 and a T-connection 36 to room temperature water tube 37. A second fitting 41 connects an optional electric pump 42 to a tube 43 that can be utilized to deliver room temperature purified water to a holding tank positioned above the unit 1 shown in FIG. 1 to supply an automatic coffee machine, if desired.

In FIG. 2, reference numeral 71 designates a 2 inch thick layer of suitable high temperature urethane insulating material (available from Dow Chemical and others) that surrounds the stainless steel hot water tank 59. Reference numeral 73 designates an ordinary electric heating strip. Numeral 75 designates the electrical power connections to heating module 73, which extends through insulation 71 to make intimate thermal contact with the outer surface of stainless steel tank 59. An inlet fitting 45 connects hot water tank 49 by means of tube 46 and T-connector 44 to the room temperature water supply tube 37. Since hot water tank 59 is located below holding tank 27, gravity feed of purified water from holding tank 27 completely fills hot water tank 59. A drain outlet connector 53 connects hot water tank 59 to a drain line 54, which is connected by a valve 65 to a suitable drain. A second outlet fitting 51 connects hot water tank 59 to hot water delivery tube 52, which passes through pinch valve 4A to manifold 7.

Cold water tank 60 is located beneath hot water tank 59, and has a similar layer of insulation 32 around it. A thermoelectric module 74 having power inlet terminal 76 extends through insulation 52 to make intimate thermal contact with the side of stainless steel cold water tank 60. The thermal electric module and control circuitry utilized here can be similar or identical to the one disclosed in the co-pending patent application entitled "THERMOELECTRIC HEATING AND/OR COOLING SYSTEM USING LIQUID FOR HEAT EXCHANGE", by James M. Kerner, Carl Palmer, Michael A. Reed, and John J. Pagendarm, commonly assigned, filed on Jan. 29, 1987, and incorporated herein by reference.

A room temperature water inlet fitting 55 connects cold water tank 60 to room temperature water supply tube 37. A drain fitting 62 connects tank 60 by tube 63 and T-connector 64 to the drain line 54. Cold water outlet fitting 56 connects tank 60 to cold water delivery tube 57, which passes through pinch valve 5A to manifold 7. Both hot water tank 59 and cold water tank 60 are vented by fittings 4 and tube 48, and fitting 58 and tube 61, respectively, into the air vent inlet 33 of holding tank 27, although tubes 48 and 61 could vent into the ambient atmosphere if their upper ends are positioned above the water level 28 in tank 27 and if microscreen filters are provided in each.

Since the manifold 7 is located below the surface level 28 of the water in holding tank 27, and since hot water tank 59 and cold water tank 60 are located beneath holding tank 27, gravity feed of water assures delivery to the selected tube, and keeps air out of the hot water tank and cold water tank.

If desired, overflow drain 66 can be positioned beneath manifold 7 behind overflow container storage door 13, and fed into an external overflow bottle 67. An optional refrigerator 69 behind refrigerator door 14 can also be drained by tube 70 into overflow bottle 67.

Figure 5A:
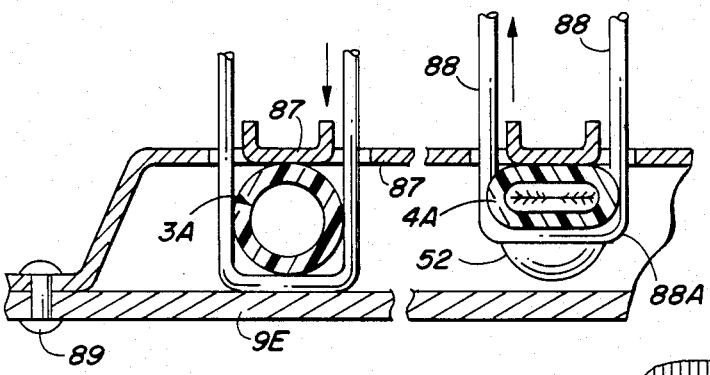
FIG. 5A is a partial section view taken along section line 5A—5A of FIG. 5.

Next, the spigot assembly will be described in detail with respect to FIG. 5, which is an enlargement of detail 5 of the section view in FIG. 4, and FIG. 5A, which shows the valve detail. Recess 2 is formed by portions 9A, 9B, and 9C of front panel assembly 9. Section 9A extends 3 inches rearward and is sloped at an angle of 15 degrees. Section 9B extends upward approximately one and one-half inches from the rear end of section 9A. Section 9C, sloped at approximately 45 degrees, extends upward at an angle of about 45 degrees approximately 5 inches from the upper end of section 9B.

Non-locking control button 4, which can be composed of nylon or polypropylene plastic material, is connected by an integral plastic hinge assembly 79. A stiff valve spring 85 includes an upper portion 85A, upper end 85B, and a lower flat portion 85C. Section 85C is sandwiched between plastic hinge connector 79 and the upper surface of recess panel 9A. When button 4 is depressed in the direction of arrow 130, a pair of valve rods 88 move downward in the direction of arrow 131. The upper end of valve rods 88 are pivotally connected to valve spring 85. At the lower end of valve rod 88, a loop 88A extends around supply tube 52, which is composed of soft three-eighths inch outside diameter FDA approved surgical tubing. Valve spring 85 pulls rods 88 and loop 88A upward against plastic supply tube 52, squeezing it against a bracket 87 through which supply tube 52 passes, pinching off the hollow channel through supply tube 52.

Thus, loop 88 and bracket 87, which is attached to upper panel 9E bounding dispensing recess 6, form a pinch valve that is closed except when button 4 is depressed in the direction of arrow 130. When this occurs, loop 88A allows supply tube 52 to relax within bracket 87, allowing hot water to pass through tube 52 into manifold 7, and into a paper cup held thereunder. If desired, an aerator vented by aerator tube 91 can be provided to mix air with water supplied to manifold 7.

Three of the above-described valve assemblies are utilized to connect the three buttons 3, 4, and 5 to pinch valves 3A, 4A and 5A of FIG. 2. The described valve structure is highly reliable, is non-locking, and allows safe dispensing of water of the selected temperature into a cup held below manifold 7. If desired, two of the buttons can be simultaneously depressed to mix hot (190 degrees Fahrenheit) water with room temperature water or to mix cold (40 degrees Fahrenheit) water with room temperature water.

Figure 6:
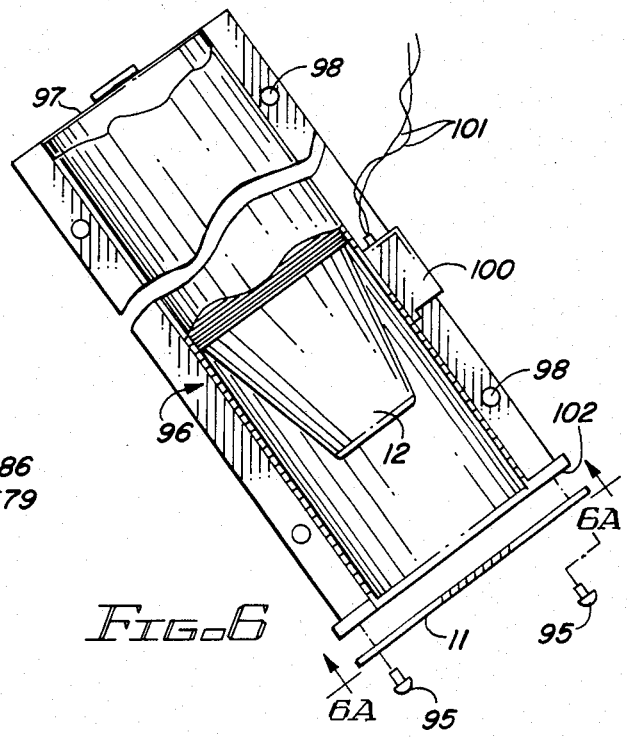
FIG. 6 is a section view of the paper cup dispensing system of the invention.
Figure 6A:
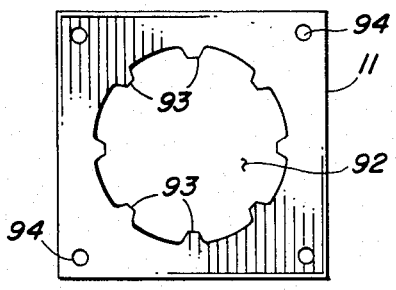
FIG. 6A is a section view along section line 6A—6A of FIG. 6.

Referring next to FIG. 6 and 6A, paper cups 12 are loaded into the interior channel of a dispensing tube 96, which is inclined at a 45 degree angle. Upper limit flange 97 prevents paper cups 12 loaded from the lower end of dispensing tube 96 from popping out of the upper end. If desired, a sensing switch 100 can be provided that sends a signal via conductors 101 to a display panel 115 (FIG. 1) when most of the loaded cups have been used.

In accordance with the present invention, a dispensing flange 11, attached to the lower end of dispensing tube 96 by flange mounting rivets 95, is composed of thin plastic, such as polypropylene. In the described embodiment of the invention, the dispensing flange 11 is only 10 mils thick. A circular opening 92 having a diameter that is one-fourth of an inch greater than the diameter of the lip of the dispensed cups 12, has a plurality of tabs 93, each one-eighth of an inch in length and one-quarter of an inch in width. It has been found that this dispensing flange prevents more than one paper cup at a time from being removed from dispensing tube 96. Therefore, the shortcoming of prior paper cup dispensers, that several cups at a time are accidentally removed, is avoided. Therefore, there is never a temptation on the part of the user to push several accidentally removed cups back into the dispenser, so the presently to be used cup is the only one ever touched by the hands of each user. Spread of germs and other contaminants from the hands of the users is thereby avoided. Furthermore, the dispensing flange 11 allows a stack of paper cups to be easily loaded from the bottom of the dispensing tube, by simply pushing the entire stack upward. The 45 degree angle of dispensing tube 96 makes it very easy for the user to see and grasp the paper cup into which the selected temperature of pure water is to be dispensed.

Figure 7B:
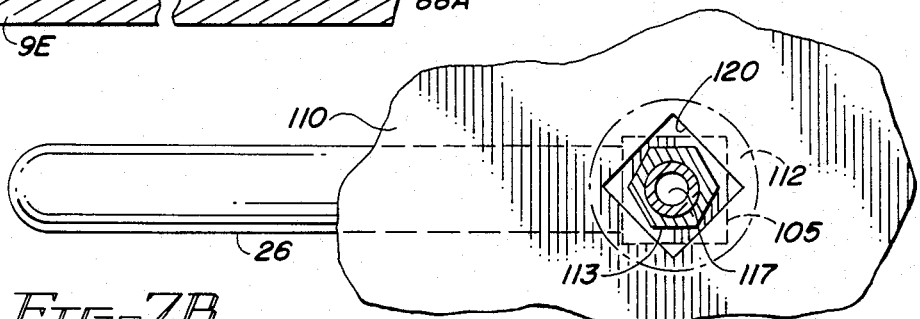
FIG. 7B is a top plan view of the float valve of FIG. 7A.

FIGS. 7A and 7B show the details of the float valve assembly 25 in FIG. 2. In order to use closed, sealed stainless steel tanks, it was necessary to design a float valve that could be inserted through a hole drilled or punched into the premanufactured sealed stainless steel tank.

In accordance with the present invention, square holes for the float valve and the other fittings are provided. In FIG. 7B, numeral 120 designates a square cut that is 0.75 inches on each side in the upper surface of holding tank 27. Float 26 can be injection molded plastic material if desired. It is attached to a valve body 103 that includes a cylindrical recess in its upper surface. A rubber cylinder 104 is disposed in the recess. Valve body 103 is pivotally connected by pivot pin 106 to the lower end of an arm of valve body 105. Valve body 105 is square, and of sufficiently small dimensions to be inserted through the square cutout opening 120. It has a threaded upper portion that extends above the upper surface of holding tank 27. After insertion of the float 26 and valve body 105, the float valve 25 is rotated 45 degrees relative to the cutout hole, as indicated in FIG. 7B. A rubber seal 112 or plastic seal washer is placed over the square cutout opening 120 and the round threaded portion 113. A flat metal washer 111 is placed over the rubber seal 112, and a nut 114 is threaded onto the threaded section 113. A conventional quarter-inch fitting can then be utilized to connect 24 to the float valve assembly 25. A conical delivery nozzle 107 extends to the upper surface of rubber seal 104 when float 26 is level, sealing off delivery of water through tube 24 to the interior of holding tank 27. When the water level 28 in holding tank 27 is low, float 26 is inclined downward as much as about 20 degrees, as indicated by dotted lines 26A, removing the surface of rubber seal 24 from the opening of nozzle 107, allowing from tube 24 to flow into tank 27.

The above float valve design allows its convenient installation in previously manufactured stainless steel tanks to provide an airtight, waterproof seal.

A similar scheme is utilized to install all of the various tube fittings to the three tanks, as shown in FIGS. 8A and 8B. In each case, a square cutout such as 127 is provided in the tank where the fitting is needed. Each fitting has a square fitting lock 126 which is inserted into the square cutout hole 127, rotated 45 degrees as indicated by reference numeral 126A, so that a round threaded portion 128 extends above the tank surface 110. A rubber seal 125, a flat washer 124 are placed over the square cutout 127, and a nut 123 is threaded onto the threaded portion 128. A suitable coupling 122 is then threaded onto portion 128 to connect the desired tube in sealed relationship to the tank.

Figure 9A:
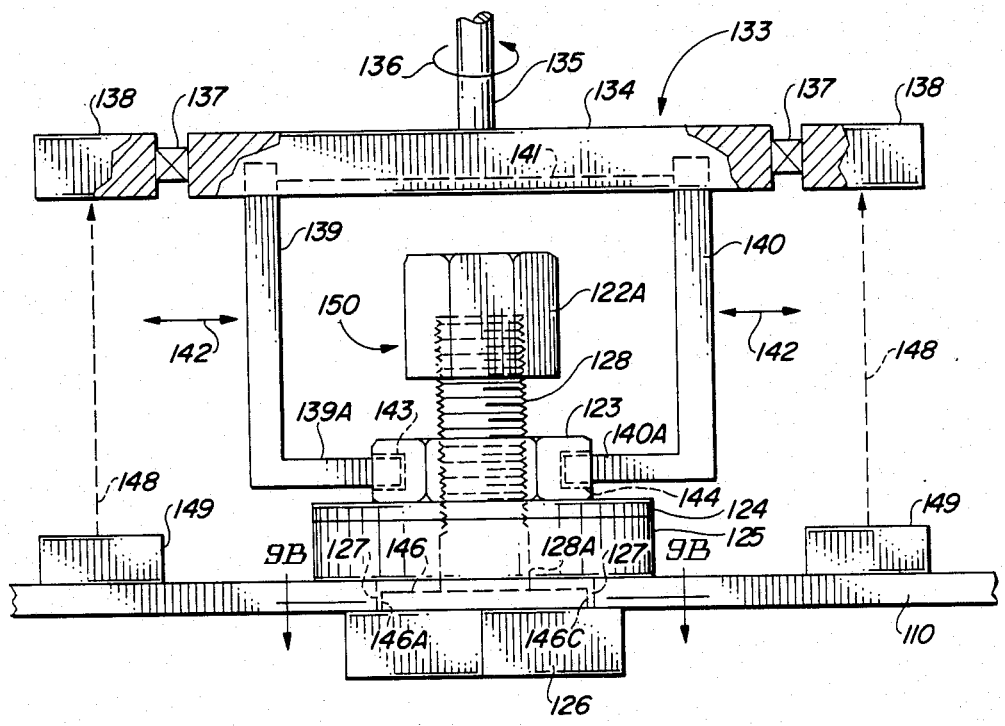
FIG. 9A is a generalized partial section view diagram of an apparatus useful in installing the fillings of FIGS. 8A and 8B in square cutout holes in the sealed stainless steel tanks.
Figure 9B:
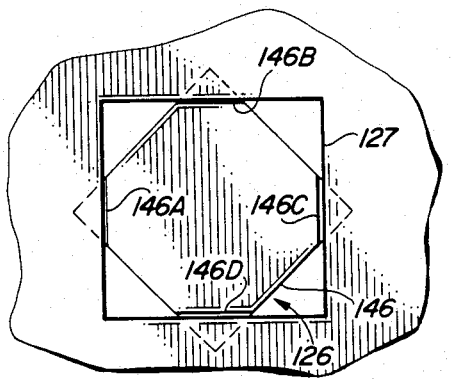
FIG. 9B is a section view along section line 9B—9B of FIG. 9A.

FIGS. 9A and 9B are useful in describing installation of the fittings shown in FIGS. 8A and 8B in the square cutout holes 127. The apparatus 133 in FIG. 9A includes a horizontal, circular support mechanism 134 that is rotataby disposed by means of bearings 137 in a stationary support frame 138. A pair of spring biased telescopic support mechanisms or the like generally indicated by dotted lines 148 exert a continuous upward force on support plate 138. The spring biased telescopic support mechanism 148 rests upon frictional pads 149, which are supported by the outer surface 110 of the stainless steel tank. As in FIGS. 8A and 8B, numeral 127 designates a square cutout hole in the surface of stainless steel tank material 110, in which the fitting, generally designated by reference numeral 150, is to be installed.

A pair of vertical arms 139 and 140 are movably supported by circular support mechanism 134. Circular support mechanism 134 is attached to a rotatable shaft 135, which can be driven by a robotic mechanism or other means. Arrow 136 designates rotation of shaft 135 and circular support mechanism 134. Dotted line 141 designates a mechanical linkage to vertical arms 139 and 140 by means of which they may be horizontally moved in the directions of arrows 142 to engage nut 123 of fitting 150 in order to tighten it.

Note that the reference numerals of fitting 150 are the same in FIGS. 9A and 9B as in FIGS. 8A and 8B. However, in FIG. 9A, recesses 143 and 144 are disposed in the vertical walls of opposite sides of nut 123. A pair of horizontal arms 139A and 140A are attached to the lower ends of vertical arms 139 and 140, respectively, and are inserted into recesses 143 and 144 by moving vertical arms 139 and 140 inward toward each other.

The threaded portion of shaft 128 is positioned above a lower unthreaded portion 128A that is attached to a slightly elevated portion 146 extending slightly above the upper surface of the base, head, or lock section 126. The elevated portion 146 has four vertical surfaces 146A, 146B, 146C, and 146D which extend into the square cutout opening 127A and engage the sides thereof to prevent the fitting 150 from rotating as nut 123 is tightened by rotating the circular mechanism 134, as described below. The spring biased telescopic mechanisms 148 maintain an upward force on nut 123, holding elevated portion 146 within square cutout 127 during the tightening, so that the base 126 does not rotate.

A sealed cap (not shown) is provided on the upper threaded end of shank 128, so that the stainless steel tank can be completely sealed prior to use in constructing the dispensing unit of FIG. 1.

The fitting 150 can be assembled as shown in FIG. 9A and then engaged by the installation apparatus 133, as also shown in FIG. 9A. The mechanism 134 is rotated to align the locking base 126 with square cutout opening 127. The mechanism 133 is urged downward, lowering the locking base 126 through the square cutout opening 127, rotating fitting 150 so that the surfaces 146A–D are aligned with square cutout opening 127 so that the portions indicated by the dotted lines in FIG. 9B are oriented as shown, and releasing the downward pressure on mechanism 133, so that the resulting upward force exerted on fitting 150 lifts elevated portion 146 into square cutout 127. The rotatable mechanism 134 can then be rotated as to tighten nut 123 to its proper tightness.

The above float valve assembly and the fitting such as 150 and the technique for installing them on a sealed tank avoids contamination due to resins used in prior silver soldering of tubes and fittings to sealed metal tanks, and avoids contamination of the insides of the sealed tank by other agents used to clean the contaminants from the resins.

The float valve assembly of FIGS. 7A and 8A can be installed using the same apparatus 133 in essentially the same manner.

It should be noted that the cutout hole shape and other corresponding shape could be other than square, as long as the necessary overlapping occurs when the valve body or base is installed relative to the cutout hole.

FIG. 3 shows the electrical connections of heating controller circuit 77 and 78, shown in detail in Appendices A and B, attached hereto to heater module 73 and cooling module 74. Power is supplied to the heating controller 77 cooling controller circuit 78 from a low cost power supply 82, which receives standard 115 volt AC power from a residential outlet. To reduce the noise in the 12 volt output produced by power supply 82, a filter module 81 can be provided to produce filtered 12 volt DC power inputs to heating control circuit 77 and cooling control module 78.

The above-described system provides an ergonomically designed, attractive water dispensing unit that is completely sealed, avoids contamination from airborne or human-carried substances, provides safe easy dispensing of hot, cold, or room temperature purified water, avoids the need for cleaning to maintain very high purity levels of dispensed water.

If desired, an additional pump can be provided to pump water from a standard five gallon bottled water container in which purified water is typically delivered, into the holding tank 25.

Pumps and tubes can be supplied as desired to supply purified water from holding tank 27 to a refrigerator icemaker, coffee maker, or other utilization device.

While the invention has been described with respect to a particular embodiment thereof, those skilled in the art will be able to make various modifications to the described embodiment without departing from the true spirit and scope of the invention. It is intended that all structures and techniques which are equivalent to those described herein in that they perform substantially the same function in substantially the same way to achieve the same result are within the scope of the invention.

We claim:

1. Apparatus for dispensing purified water, comprising in combination:

(a) sealed holding tank means for holding water at room temperature and means for delivering purified water into the holding tank means;

(b) a first delivery tube coupled between a first dispensing port and the holding tank means, and first valve means for controlling flow of water through the first dispensing port;

(c) microfilter venting means for filtering minute bacteria, particles, and the like from any air vented into the holding tank;

(d) sealed hot water tank means for heating and storing water;

(e) a second delivery tube coupled between a second dispensing port and the hot water tank means, and second valve means for controlling flow of hot water through the second dispensing port;

(f) first feed tube means for gravity feeding room temperature water from the holding tank means into the hot water tank means;

(g) a first vent tube coupled between the top of the hot water tank means and the top of the holding tank means;

(h) sealed cold water tank means for cooling and storing water;

(i) a third delivery tube coupled between a third dispensing port and the cold water tank means, and third valve means for controlling flow of cooled water through the third dispensing port, the first, second, and third dispensing ports being below the level of water in the holding tank means;

(j) second feed tube means for gravity feeding room temperature water from the holding tank means into the cold water tank means;

(k) a second vent tube coupled between the top of the cold water tank means and the top of the holding tank means;

(l) means for supporting the holding tank means above the hot water tank means and the cold water tank means, whereby purified water is isolated from airborne bacteria and other contaminants in the apparatus;

(m) first, second, and third actuating buttons remote from the first, second, and third dispensing ports, and linking means for operatively connecting the first, second, and third actuating buttons to the first, second, and third valve means, respectively, wherein each of the first, second, and third valve means includes a section of flexible tubing and means for pinching off the section of flexible tubing, and wherein the linking means includes, for each actuating button, a spring engaging that button and deformable by depressing that button, an elongated linking member connected to the spring and the pinching means for pinching off the section of flexible tube when that button is not depressed, and for unpinching the section of flexible tube by depressing that button, wherein the first, second, and third buttons are disposed in a button recess in a front panel of a housing of the apparatus located above a dispensing recess, the first, second, and third dispensing ports being located at the top of the dispensing recess, the button recess having a lower surface having a slope of approximately fifteen degrees and limiting downward movement of the first, second, and third actuating buttons, each linking member extending directly downward from the corresponding actuating button to the corresponding pinching means.

2. The apparatus of claim 1 wherein the holding tank means has at least the combined capacity of the hot water tank means and the cold water tank means.

3. The apparatus of claim 2 wherein the holding tank means, hot water tank means, and cold water tank means are composed of stainless steel, and including insulating means surrounding the hot water tank means and the cold water tank means.

4. The apparatus of claim 3 wherein the cold water tank means includes a thermoelectric module means connected in low thermal resistance relationship to a side of a stainless steel container portion thereof, and the hot water tank means includes an electric heater module connected in low thermal resistance relationship to a side of a stainless steel container portion thereof.

5. The apparatus of claim 1 wherein the first, second, and third buttons are located approximately 36 inches above the floor, and the first, second, and third dispensing ports are located approximately 28 inches above the floor, and the top of the apparatus is located approximately 40 inches above the floor.

6. The apparatus of claim 5 including a paper cup dispenser located beside the dispensing recess.

7. The apparatus of claim 6 wherein the paper cup dispenser includes a cup storage tube for holding a stack of paper cups and a thin plastic flexible dispensing flange attached to a lower end of the cup storage tube the dispensing flange including a circular opening and a plurality of spaced flexible tab means disposed along the edge of the circular opening for yielding to the lip of a paper cup being withdrawn and recovering to its initial position to retain the lip of the next higher paper cup, wherein the tab means each are coplanar with the dispensing flange except when the lip of a paper cup is being pulled through the circular opening.

8. The apparatus of claim 7 wherein the cup storage tube is inclined at a 45 degree angle, the dispensing flange is perpendicular to the cup storage tube, the bottom of the lowest paper cup in the stack extending generally toward the front of the apparatus to effectuate convenient removal thereof by a user.

9. The apparatus of claim 8 wherein the dispensing flange is approximately one-thirty-second of an inch thick and the tabs each extend approximately on-eighth of an inch inward from the edge of the circular opening.

10. The apparatus of claim 1 wherein the purified water delivery means includes a float valve means for limiting the flow of purified water into the holding tank means when the purified water in the holding tank means reaches a certain level, all water inlets of the holding tank means, hot water tank means, and the cold water tank means including sealed fitting connections to the respective holding tank means, hot water tank means, and cold water tank means.

11. The apparatus of claim 1 wherein the purified water delivery means includes a pump means for pumping water out of a water bottle into the holding tank means.

12. The apparatus of claim 10 wherein the float valve means includes a threaded cylindrical section extending upward from a valve body having a square perimeter that is slightly smaller than a square cutout hole in the holding tank means and a passage through the threaded cylindrical section and through the valve body, the valve body being inside the holding tank means and oriented so that its square perimeter is rotated 45 degrees relative to the square cutout hole, the threaded cylindrical section extending upward through the square cutout hole, the float valve means including a plastic seal washer on the outer surface of the holding tank means covering the edge of the square cutout hole and sealing the outer surface of the holding tank means to the threaded cylindrical section, a rigid flat washer on the upper surface of the plastic seal washer, a nut threaded on the threaded cylindrical section tightening the washer against the plastic seal washer, a float mechanism inside the holding tank means pivotally connected to the valve body and having a resilient seal which engages and seals a nozzle when the float mechanism is pushed upward by the water in the holding tank means, the float valve means being elongated and of sufficiently small cross section to be inserted into the holding tank means through the square cutout hole.

* * * * *